US006347199B1

(12) United States Patent
Morihara

(10) Patent No.: US 6,347,199 B1
(45) Date of Patent: Feb. 12, 2002

(54) TONER SUPPLY METHOD IN PICTURE IMAGE FORMING SYSTEM AND PICTURE IMAGE FORMING SYSTEM

(75) Inventor: Kazushige Morihara, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/706,354

(22) Filed: Nov. 6, 2000

(51) Int. Cl.[7] ..... G03G 15/08; G03G 15/01

(52) U.S. Cl. ..... 399/27; 399/61; 399/62; 399/81; 399/224; 399/262

(58) Field of Search ..... 399/27, 30, 61, 399/62, 258, 262, 119, 223, 224, 81

(56) References Cited

U.S. PATENT DOCUMENTS

| | | | | |
|---|---|---|---|---|
| 4,982,242 A | * | 1/1991 | Ishii et al. | 399/262 X |
| 5,070,368 A | * | 12/1991 | Okano et al. | 399/62 |
| 5,218,407 A | * | 6/1993 | Matsushita et al. | 399/262 X |
| 5,502,553 A | * | 3/1996 | Masuda et al. | 399/119 X |
| 5,867,757 A | * | 2/1999 | Okazaki et al. | 399/262 |
| 6,021,294 A | * | 2/2000 | Schmidl et al. | 399/258 |
| 6,167,227 A | * | 12/2000 | Fujita et al. | 399/258 |

FOREIGN PATENT DOCUMENTS

| | | |
|---|---|---|
| JP | 6-83196 | 3/1994 |

* cited by examiner

*Primary Examiner*—Susan S. Y. Lee
(74) *Attorney, Agent, or Firm*—Foley & Lardner

(57) ABSTRACT

There is provided a toner supply method in a picture image forming system having a plurality of picture image forming parts, each of which is designed to supply a toner from a toner cartridge to a developing part, the toner supply method having the steps of: detecting a cartridge empty when the level of the toner in the toner cartridge of any one of the picture image forming parts becomes an empty level; introducing a toner, which remains in the toner cartridge of each of the plurality of picture image forming parts, from the toner cartridge of a corresponding one of the plurality of picture image forming parts into a reserve tank portion, which is provided so as to correspond to each of the toner cartridges for housing therein a predetermined quantity of toner, when the cartridge empty is detected in any one of the picture image forming parts; detecting a toner empty when the level of the toner in the developing part becomes an empty level in any one of the picture image forming parts; and inspiring to replace all of the toner cartridges, for which a cartridge empty has been detected, with new cartridges when the toner empty is detected in any one of the picture image forming parts.

22 Claims, 10 Drawing Sheets

TONER SUPPLY METHOD IN PICTURE IMAGE FORMING SYSTEM AND PICTURE IMAGE FORMING SYSTEM

BACKGROUND OF THE INVENTION

1. Field of the Invention

The present invention relates generally to a toner supply method in a picture image forming system, and a picture image forming system. More specifically, the invention relates to a toner supply method in a picture image forming system, which enables replacement of not only a toner cartridge running short of toner in a picture image forming system for making copies with toners of a plurality of colors, but also, simultaneously, a toner cartridge for a toner which is running short, and to the picture image forming system itself.

2. Related Background Art

In a picture image forming system for making copies with toners of a plurality of colors, the quantities of toners consumed by making several copies vary depending on the colors of the toners. For example, a picture image forming system for making copies with toners of four colors including Y (yellow), M (magenta), C (cyanogen) and K (black) is considered. After such a picture image forming system makes several copies, a toner cartridge for, e.g., a toner Y, becomes empty (a toner cartridge empty). Then, when the toner specific concentration thereof lowers to a level which is not suitable for copying (a toner empty), the toner cartridge for the toner Y is replaced. Similarly, when the state of a toner M is changed from "toner cartridge empty" to "toner empty", the toner cartridge for the toner M must be replaced.

There are some cases where the toner cartridge for the toner M must be replaced immediately after the toner cartridge for the toner Y is replaced. In such cases, the replacing operation is very complicated.

SUMMARY OF THE INVENTION

It is therefore an object of the present invention to do away with the complicated replacing operation for a toner cartridge for each color, which is caused by replacing a toner cartridge separately from and independently of other toner cartridges for the respective colors.

It is another object of the present invention to prevent the complicated replacing operation by simultaneously replacing toner cartridges for a plurality of colors.

It is a further object of the present invention to prevent a toner cartridge from being disposed with the a toner remaining in the toner cartridge.

It is a still further object of the present invention to easily recognize time to replace toner cartridges for toners of a plurality of colors, by displaying the time to replace the toner cartridges.

In order to accomplish the aforementioned and other objects, according to one aspect of the present invention, there is provided a toner supply method in a picture image forming system having a plurality of picture image forming parts, each of which is designed to supply a toner from a toner cartridge to a developing part, the toner supply method comprising the steps of: detecting a cartridge empty when the level of the toner in the toner cartridge of any one of the picture image forming parts reaches an empty level; introducing a toner, which remains in the toner cartridge of each of the plurality of picture image forming parts, from the toner cartridge of a corresponding one of the plurality of picture image forming parts into a reserve tank portion, which is provided so as to correspond to each of the toner cartridges for housing therein a predetermined quantity of toner, when the cartridge empty is detected in any one of the picture image forming parts; detecting a toner empty when the level of the toner in the developing part reaches an empty level in any one of the picture image forming parts; and exchanging all of the toner cartridges, for which a cartridge empty has been detected, for new cartridges when the toner empty is detected in any one of the picture image forming parts.

According to another aspect of the present invention, there is provided a toner supply method in a picture image forming system including first and second picture image forming parts, the toner supply method comprising the steps of: detecting a cartridge empty of the first picture image forming part when the level of a toner in the toner cartridge of the first picture image forming part reaches an empty level; introducing a toner, which remains in each of the toner cartridges of the first and second picture image forming parts, from each of the toner cartridges of the first and second picture image forming parts into a reserve tank, which is provided so as to correspond to each of the toner cartridges for housing therein a predetermined quantity of toner, when the cartridge empty is detected in the first picture image forming parts; detecting a cartridge empty of the second picture image forming part when the level of a toner in the toner cartridge of the second picture image forming part reaches an empty level; introducing a toner, which remains in each of the toner cartridges of the first and second picture image forming parts, from each of the toner cartridges of the first and second picture image forming parts into a reserve tank, which is provided so as to correspond to each of the toner cartridges for housing therein a predetermined quantity of toner, when the cartridge empty is detected in the second picture image forming parts; detecting a toner empty of a corresponding one of the first and second image forming parts when the level of the toner in the developing part of any one of the first and second picture image forming parts reaches the empty level; and inspiring to replace the toner cartridges of the first and second picture image forming parts with new cartridges when the toner empty is detected in any one of the first and second picture image forming parts.

According to another aspect of the present invention, there is provided a picture image forming system comprising: a plurality of developing means, each of which houses toner therein, for forming a developer image with the toner; a plurality of toner cartridges, each of which is provided so as to correspond to a corresponding one of the plurality of developing means, for supplying the toner to the corresponding one of the plurality of developing means; a plurality of reserve tank portions, each of which is provided between the corresponding one of the plurality of developing means and a corresponding one of the plurality of toner cartridges, for housing therein a predetermined quantity of toner to supply the toner to the corresponding one of the plurality of developing means; a plurality of cartridge empty detecting means, each of which is provided in the corresponding one of the plurality of toner cartridges, for detecting that the level of the toner in the corresponding one of the plurality of toner cartridges reaches an empty level; a plurality of toner empty detecting means, each of which is provided in the corresponding one of the plurality of developing means for detecting that the level of the toner in the corresponding one of the plurality of developing means reaches an empty level; introducing means for introducing a toner, which remains in a corresponding one of the plurality of toner cartridges, from the corresponding one of the plurality of toner cartridges to a corresponding one of the reserve tank portions when a cartridge empty of any one of the plurality of toner cartridges is detected by a corresponding one of the plurality of cartridge empty detecting means; and display means for displaying to inspire to exchange one or more toner cartridges of the plurality of toner cartridges, the level of which has reached the cartridge empty, when a toner empty of any one of the plurality of developing means is detected by a corresponding one of the plurality of toner empty detecting means after the toner is introduced by the introducing means.

According to another aspect of the present invention, there is provided a toner supply method in a picture image forming system having a plurality of picture image forming parts, each of which is designed to supply a toner from a toner cartridge to a developing part, the toner supply method comprising the steps of: detecting a toner empty when the level of the toner in the developing part in any one of the picture image forming parts reaches an empty level; supplying a toner to a developing part from a reserve tank portion, which is provided in each of the picture image forming parts and which stores therein a predetermined quantity of toner, via a reserving supply passage in a corresponding one of the picture image forming parts, when the toner empty is detected in the corresponding one of the picture image forming parts; and inspiring to replace with new ones toner cartridges of all of picture image forming parts, in which the toner empty has been detected, when a toner empty is detected again in any one of the picture image forming parts after the toner is supplied from the reserve tank to the developing part.

According to a further aspect of the present invention, there is provided a toner supply method in a picture image forming system having first and second picture image forming parts, the toner supply method comprising the steps of: detecting a toner empty in the first picture image forming part; discontinuing forming a picture image when the toner empty is detected in the first picture image forming part, and resuming forming a picture image after a toner is supplied to a corresponding developing part from a reserve tank portion which is provided in the first picture image forming part; detecting a toner empty in the second picture image forming part; discontinuing forming a picture image when the toner empty is detected in the second picture image forming part, and resuming to form a picture image after a toner is supplied to a corresponding developing part from a reserve tank portion which is provided with the second picture image forming part; and inspiring to replace toner cartridges of the first and second picture image forming parts with new ones when a toner empty is detected again in the first or second picture image forming part.

According to a still further aspect of the present invention, there is provided a picture image forming system comprising: a plurality of developing means, each of which houses therein a toner, for forming a developer image with the toner; a plurality of toner cartridges, each of which is provided so as to correspond to a corresponding one of the plurality of developing means, for supplying the toner to the corresponding one of the plurality of developing means; a plurality of reserve tank portions, each of which is provided so as to correspond to the corresponding one of the plurality of developing means, for housing therein a predetermined quantity of toner to supply the toner to the corresponding one of the plurality of developing means; a plurality of toner empty detecting means, each of which is provided in the corresponding one of the plurality of developing means, for detecting that the level of the toner in the corresponding one of the plurality of developing means reaches an empty level; supply means for supplying a toner from a corresponding one of the reserve tank portions to the corresponding one of the plurality of developing means when a toner empty of any one of the plurality of developing means is detected by a corresponding one of the plurality of toner empty detecting means; and display means for displaying a message to inspire to replace with new ones all of corresponding cartridges of the plurality of toner cartridges, which correspond to one or more of the plurality of developing means in which a toner empty has been detected, when a toner empty of any one of the plurality of developing means is detected by a corresponding one of the plurality of toner empty detecting means after the toner is supplied by the supply means.

BRIEF DESCRIPTION OF THE DRAWINGS

The present invention will be understood more fully from the detailed description given hereinbelow and from the accompanying drawings of the preferred embodiments of the invention. However, the drawings are not intended to imply limitation of the invention to a specific embodiment, but are for the purpose of explanation and understanding only.

In the drawings.

DESCRIPTION OF THE PREFERRED EMBODIMENTS

The preferred embodiments of the present invention are described below.

Figure 1:
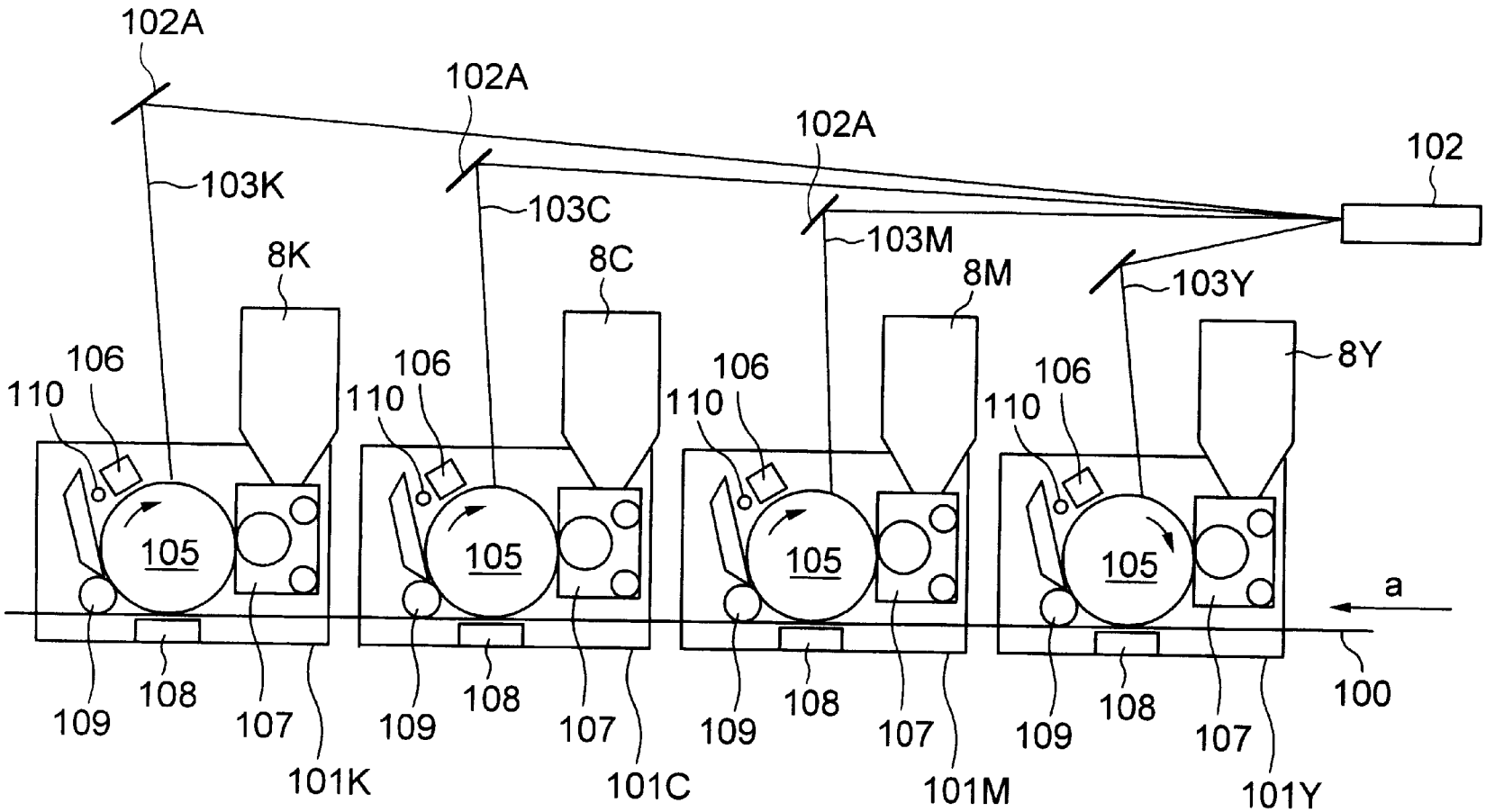
FIG. 1 is a side view of a principal part of a picture image forming system to which the present invention is applied.

FIG. 1 shows a principal part of a color picture forming system to which the present invention is applied. As can be seen from FIG. 1, picture image forming units 101Y, 101M, 101C and 101K for the four colors Y, M, C and K are provided. To these units, read picture signals are inputted as laser light beams of four colors 103Y, 103M, 103C and 103K from a polygon mirror 102 and a reflecting mirror 102A of an exposure device. On the basis of these laser beams, a picture image is formed in each of the picture image forming units, so that the picture images of Y, M, C and K are sequentially transferred to recording paper (not shown) which is conveyed by a conveyance belt 100 in a direction of arrow "a" in the figure. Although this structure is not described in detail, it will be briefly described below. In each of the picture image forming units, reference number 105 denotes a photosensitive material drum; reference number 106 denotes an electrifying device for electrifying the photosensitive material drum 105; reference number 107 denotes a developing device for developing a toner image in accordance with a latent image which is drawn on the photosensitive material drum 105 by laser beams; reference number 108 denotes a transferring device for transferring the toner image to recording paper; reference number 109 denotes a cleaning device; and reference number 110 denotes a de-electrifying device. To each of the developing devices 107, toners Y, M, C and K are supplied from toner cartridges 8, specifically toner cartridges 8Y, 8M, 8C and 8K.

In a picture image forming system with the above described construction, the toners Y, M, C and K in the toner cartridges 8 decrease as copies are continuously made. According to the present invention, instead of replacing a single toner cartridge each time, a plurality of toner cartridges can be simultaneously replaced, so that it is possible to keep the exchanging operation of the toner cartridges from being complicated.

Each of the preferred embodiments will be described in detail below.

First Preferred Embodiment

First, the first preferred embodiment of the present invention will be described.

One feature of the first preferred embodiment is as follows. When a toner cartridge for a toner of a certain color becomes empty, toner outlets to the reserve tank portions of toner cartridges for the toners of all of colors are forced to be open, so that the remaining toners are introduced into the reserve tank portions. This operation is repeated every time the toner cartridges for any one of toners of all of colors become empty. Thereafter, when a toner of a certain color is determined to be in a toner empty on the basis of a toner specific concentration, the toner cartridges having been empty are simultaneously replaced so as to avoid the complicated replacing process that each time a toner is running short, the toner cartridge therefor is replaced.

Figure 2A:
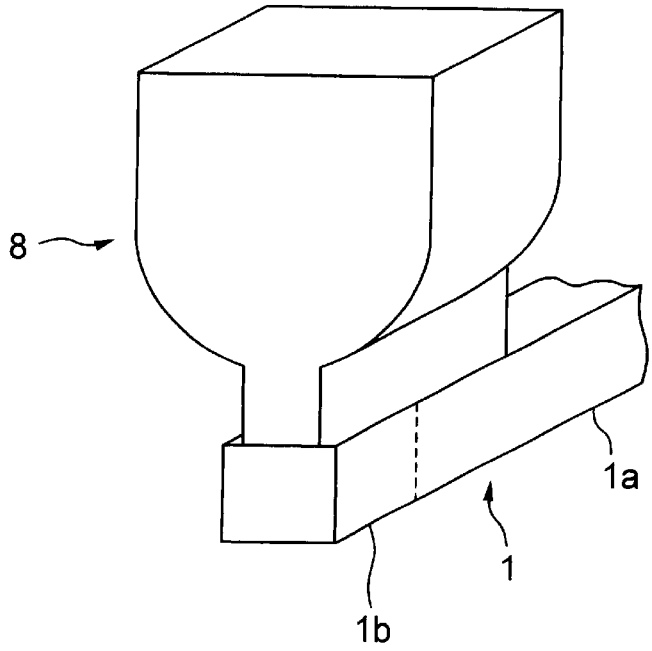
FIG. 2(*a*) is a perspective view of a principal part of a preferred embodiment of the present invention, FIG. 2(*b*) is a schematic diagram showing an optical toner detecting mechanism, and FIG. 2(*c*) is a schematic diagram showing an operation panel.
Figure 2B:
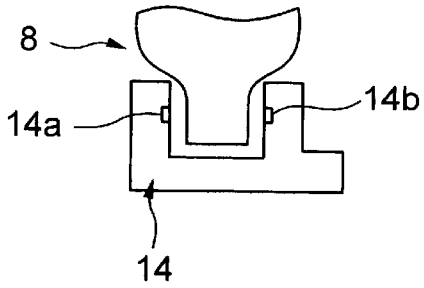
Figure 2C:
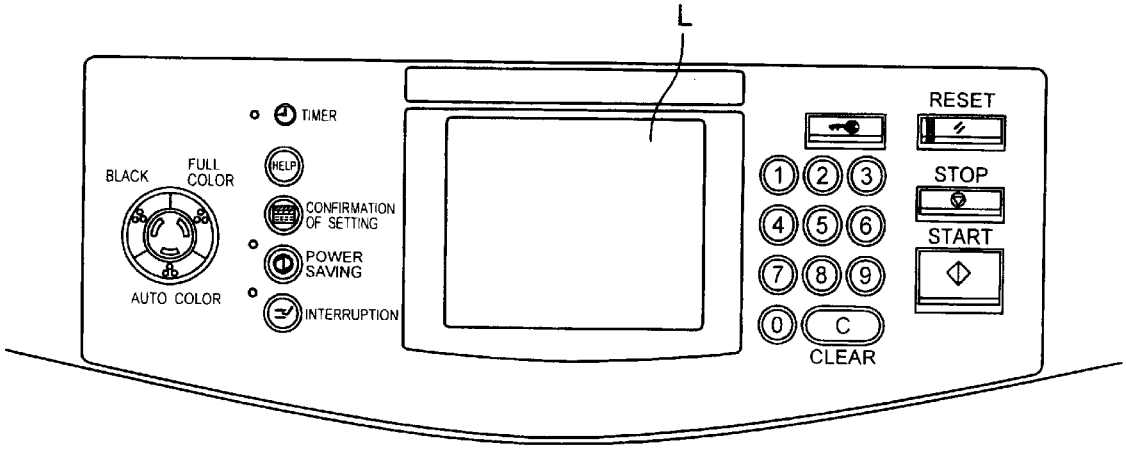
Figure 3:
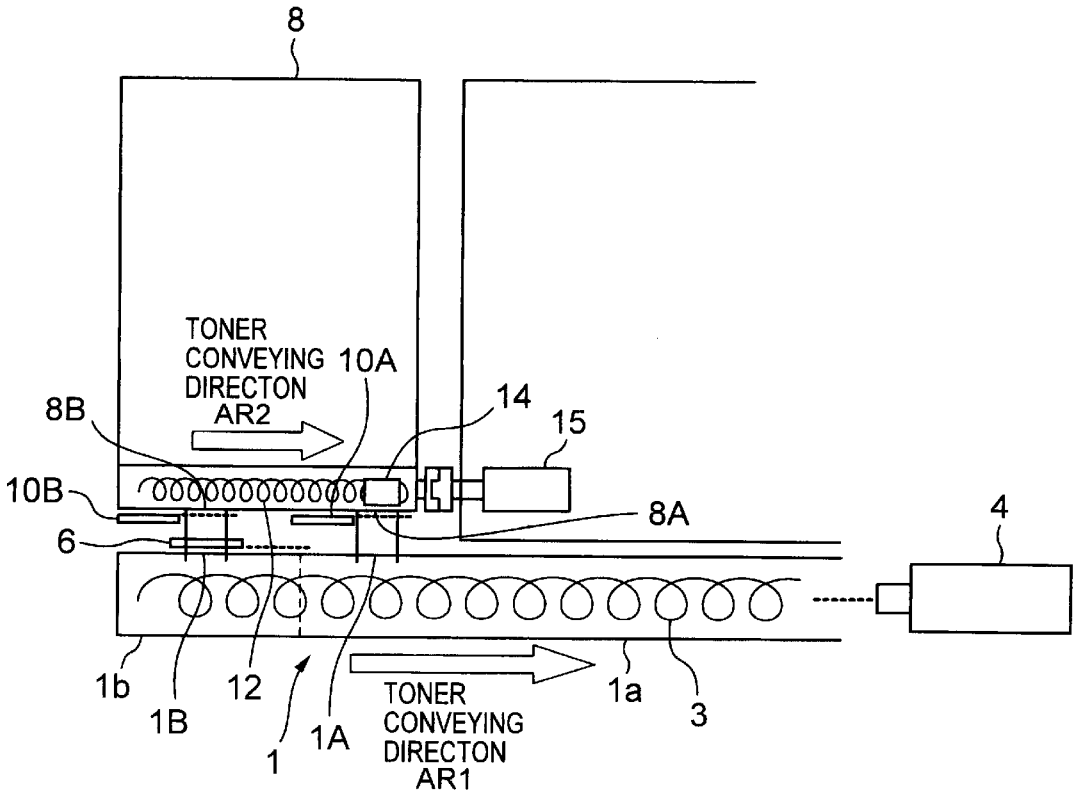
FIG. 3 is a side view of a principal part of a preferred embodiment of the present invention.

Referring to the accompanying drawings, the first preferred embodiment of the present invention will be described in detail below. FIG. 3 is a sectional side view of a principal part of a system according to the present invention, and FIG. 2(*a*) is a perspective view of the system. FIGS. 2(*b*) and 2(*c*) show an optical toner detecting mechanism and operation panel of the system, respectively. As can be seen from FIG. 3, a toner tank 1 is divided into a tank body portion la serving as a usual toner tank, and a reserve tank portion 1*b* which is arranged on the tip side (on the left in the figure) and which serves as a place for temporarily storing therein a toner remaining in a toner cartridge. In the toner tank 1, a toner conveying auger 3 rotated by a developing device motor 4 is provided. By the rotation of the auger 3, the toner is conveyed in a direction of arrow AR1 to be fed to a developing part while a developer is agitated. In the toner tank 1, a well-known sensor for detecting a toner specific concentration in the developer is provided. This toner specific concentration detecting sensor will be described later. In a usual state, the toner is supplied from the toner cartridge 8 to the tank body portion 1*a* via a usual supply passage, but no toner is supplied to the reserve tank portion 1*b*. Therefore, the reserve tank portion 1*b* is emptied by the rotation of the auger 3.

The top face of the tank body portion la of the toner tank 1 is formed with a tank body inlet 1A and a reserve tank inlet 1B. The reserve tank inlet 1B is provided with a shutter 6 for opening and closing the inlet 1B. The shutter 6 is usually closed, but is opened when the toner is supplied to the reserve tank portion 1*b*. By opening and closing the shutter 6, a reserve supply passage between the reserve tank portion 1*b* and the toner cartridge 8 is established and blocked, respectively.

The bottom face of the toner cartridge 8, which is detachably mounted on the toner tank 1 with the above described construction, is provided with a first opening 8A and a second opening 8B. The first opening 8A faces the tank body inlet 1A of the toner tank 1, and the second opening 8B faces the reserve tank inlet 1B. The first and second openings 8A and 8B are provided with first and second lids 10A and 10B, respectively.

The lids 10A and 10B are open when the toner cartridge 8 is attached, and closed when the toner cartridge 8 is detached. Thus, the usual supply passage between the first opening 8A and the tank body inlet 1A, and the reserve supply passage between the second opening 8B and the reserve tank inlet 1B are automatically established and blocked in accordance with the attachment and detachment of the toner cartridge 8. However, the shutter 6 exists in the reserve tank inlet 1B as described above.

In such a toner cartridge 8, an auger 12 for conveying a toner in a direction of arrow AR2 is provided on the bottom side thereof. By this auger 12, the toner in the toner cartridge 8 is efficiently conveyed therein to drop from the first opening 8A to be introduced into the toner tank 1. In the vicinity of the first opening 8A, a cartridge sensor 14 is provided. This sensor 14 detects the presence of the toner in the cartridge 8. That is, when the toner conveyed by the anger 12 to drop from the first opening 8A runs short, the sensor 14 detects that the toner cartridge 8 is empty (a cartridge empty). The auger 12 is rotated by a toner motor 15 which is provided outside of the toner cartridge 8.

In place of the sensor 14, a light emitting part 14*a* and a light receiving part 14*b* may be provided so as to face to each other via the usual supply passage of the toner cartridge 8, as shown in FIG. 2(*b*), to optically detect the presence of the toner.

Figure 13:
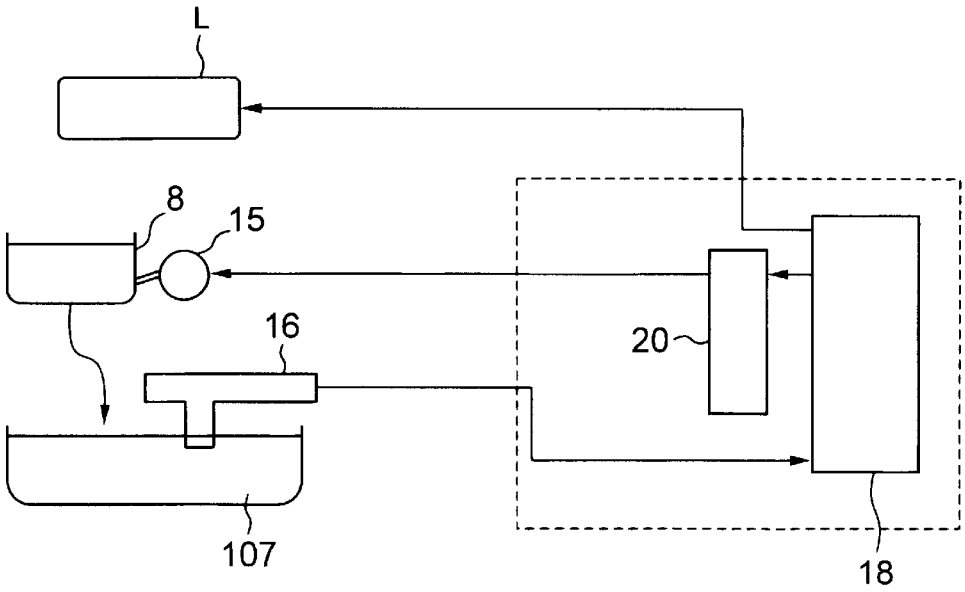
FIG. 13 is a block diagram for explaining the function of a toner specific concentration detecting sensor.

The toner specific concentration detecting sensor 16 described by referring to FIG. 13 will be described below. The toner specific concentration detecting sensor 16 is provided in each of the developing devices 107 for the respective colors, and detects the concentration of the toner in a developer consisting of a carrier and the toner. The detection principle is as follows. The toner specific concentration detecting sensor 16 forms a magnetic circuit in the developer to detect the variation in magnetic resistance in the developer. That is, if the quantity of the toner with respect to the carrier in the developer decreases, the magnetic resistance decreases, and, on the contrary, if the quantity of the toner increases, the magnetic resistance increases. Such variation in magnetic resistance is detected by a detecting part (not shown) and fed to a main CPU 18 as a toner specific concentration signal. The main CPU 18 receives the toner specific concentration signal and drives the toner motor 15 via a gate array 20 in accordance with the contents of the signal.

Accordingly, the toner is supplied from the toner cartridge to the developing device so that the concentration of the toner in the developing device 107 is maintained constant.

Figure 12:
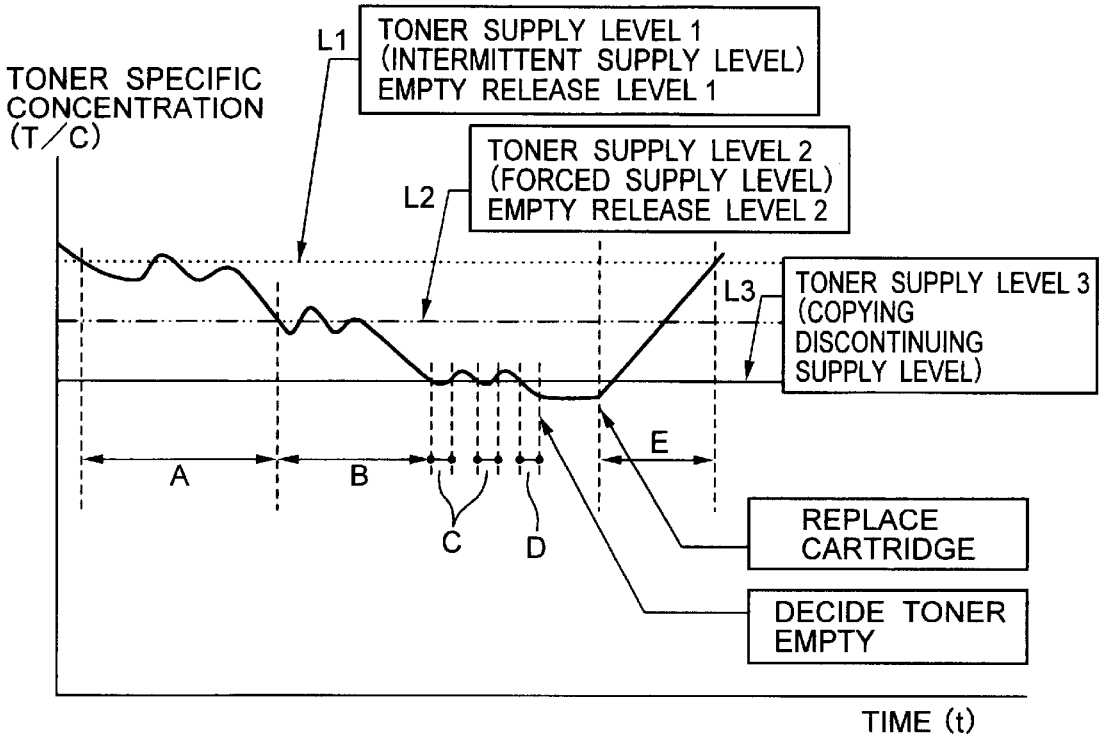
FIG. 12 is a graph showing an example of the variation in toner specific concentration in a picture image forming system.

As shown in FIG. 12(*c*), a general purpose display device is provided for displaying a message indicating a near empty or a toner empty. This display device is provided on an operating part of the picture image forming system body, and has a liquid crystal panel portion L on which various messages are displayed. Specifically, the main CPU 18 receives output signals from the cartridge sensor 14 and the toner specific concentration detecting sensor 16 to control the liquid crystal panel L to display a message indicating near empty or an empty.

Figure 5:
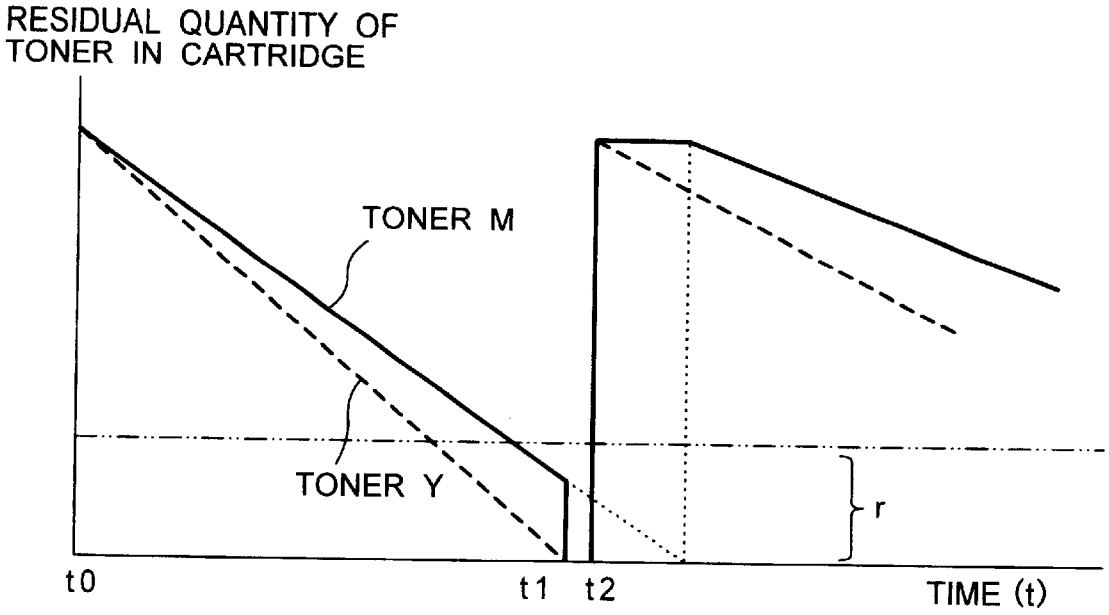
FIG. 5 is a graph showing an example of an operation in a preferred embodiment of the present invention.

Referring to FIG. 5, an example of the operation of the system with the above described construction will be described below. There will be herein described a case where the toner Y first runs short and where the residual quantity of the toner M, which is low at this time, is smaller than that in the reserve tank portion. From time t0, the toners Y and M are decreasing in accordance with the copying operation. At time t1, the toner Y runs short in the toner cartridge 8. At this time, a slight amount of the toner M remains in the toner cartridge 8 although the residual quantity of the toner M is smaller than the volume r of the reserve tank portion 1*b*. At this time t1, the shutters 6 for all of the toners Y, M, C and K are open. All of the toner M in the toner cartridge 8 drops into the reserve tank portion 1*b*. Thus, the residual quantity of the toner M in the toner cartridge becomes zero at a time (time t1). It is assumed that by the subsequent copying operation, a toner empty is detected from the toner concentration ratio with respect to, e.g., the toner Y. In response thereto, the toner cartridges 8 for the toners Y and M are replaced at time t2. Thus, the quantities of the toners Y and M increase. Thus, by simultaneously replacing the toner cartridge 8 for the toners M and Y, it is possible to void replacing the cartridge 8 for the toner M immediately after the cartridge 8 for the toner Y is replaced.

Figure 4:
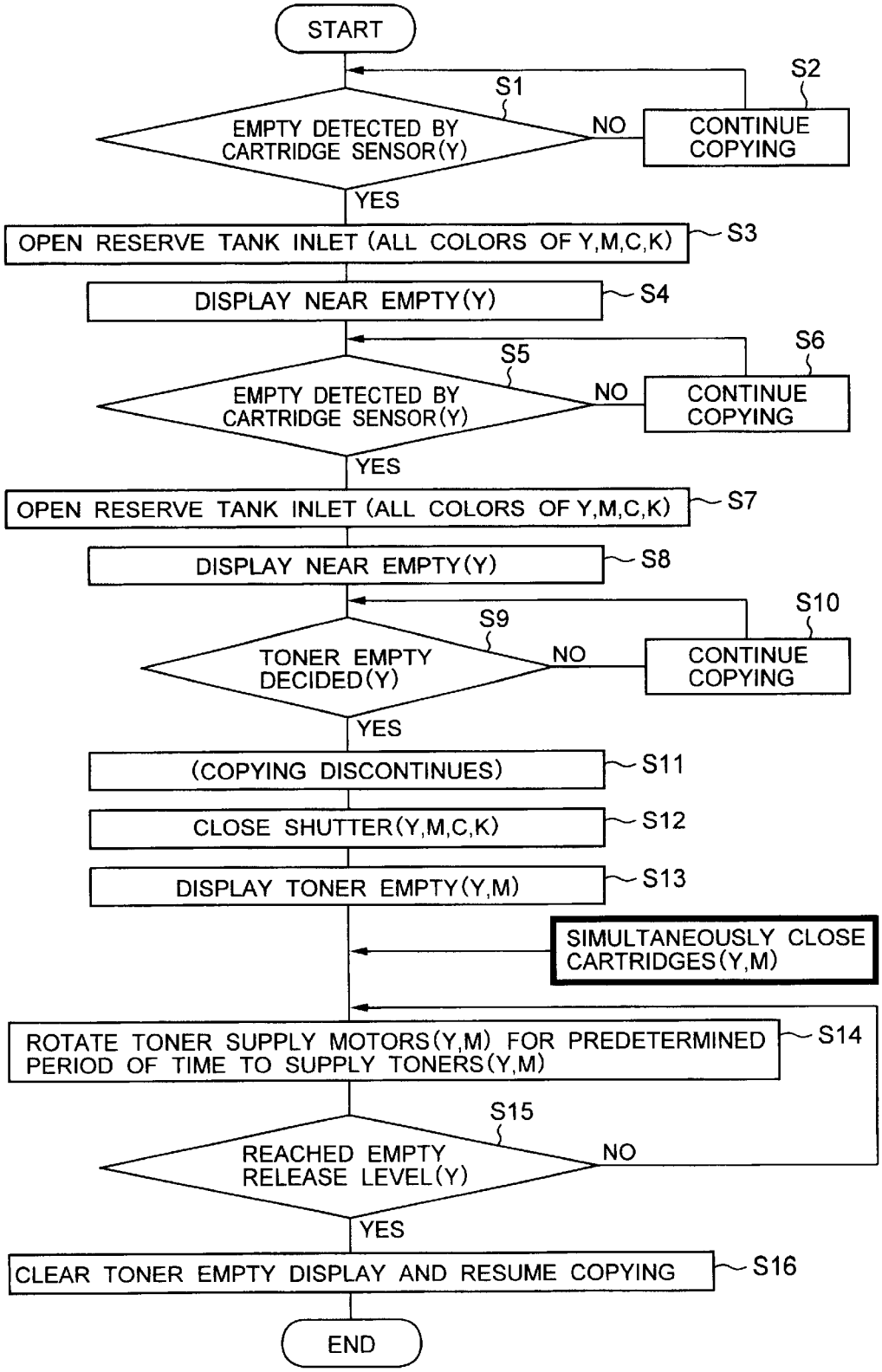
FIG. 4 is a flow chart of an example of an operation in a preferred embodiment of the present invention.

Referring to FIG. 4, the above described operation will be described in more detail below.

Until a cartridge empty is detected in the toner cartridges for the toners Y, M, C and K by the cartridge sensor 14, a copying operation continues (NO of step S1, step S2).

For example, it is assumed that a cartridge empty is detected by the cartridge sensor 14 for the toner Y (YES of step S1). In this case, a control signal is outputted to open the shutters 6 of the reserve tanks 1*b* for all the colors of the toners Y, M, C and K (step S3). Simultaneously, a near empty is displayed with respect to the toner Y (step S4). That is, it is displayed that with respect to the toner Y, the toner cartridge 8 is empty, and there is only the toner remaining in the toner tank 1.

Thereafter, a copying operation is carried out with the toner Y remaining in the toner tank 1 and other toners in both of the toner cartridges 8 and toner tanks 1 (NO of step S5, step S6).

If a cartridge empty is detected by the cartridge sensor 14 for the toner M (YES of step S5), a control signal is outputted again. By this control signal, the shutters 6 of the reserve tank portions 1*b* for the toners Y, M, C and K of all of colors are open. In practice, the opening operation is not carried out again since the shutters 6 have been opened at the preceding step S3. The technical significance herein is that the shutters 6 of the reserve tanks 1*b* for all of the toners Y, M, C and K are open even if the toner cartridge 8 for the toner M becomes empty before the toner cartridge 8 for the toner Y becomes empty, although in the example described herein, the toner cartridge 8 for the toner M becomes empty after the toner cartridge for the toner Y becomes empty. Simultaneously, a near empty is displayed with respect to the toner M (step S8).

Thereafter, the copying operation continues (NO of step S9, step S10). After this copying operation, if it is determined on the basis of the toner specific concentration that the toner Y is in a toner empty (YES of step S9), the copying operation discontinues (step S11). Simultaneously, the shutters 6 for all of the toners Y, M, C and K are closed (step S12), and a message indicating a toner empty is displayed to indicate that the toners Y and M do not exist in the toner cartridges 8 (step S13).

The user looks at this toner empty display to simultaneously replaces the toner cartridges 8 for the toners Y and M. At this time, the toners in the toner cartridges 8 are introduced into the tank body portions 1*a*. In this state, the augers 12 are rotated by the toner motors 15 for a predetermined period of time to efficiently supply the toners Y and M (step S14). The toners introduced into the tank body portions la are also conveyed by the augers 3. Then, the toners Y and M are supplied until the concentration of the toner Y, the toner concentration ratio of toner Y having fallen to the empty state once, reaches a predetermined empty clear level (see level L1 in FIG. 12 which will be described later) (NO of step S15, step S14). Then, when the concentration of the toner Y reaches the release level (YES of step S15), the toner empty displays for the toners Y and M are cleared, and a copying operation is resumed (step S16).

Second Preferred Embodiment

Another preferred embodiment will be described below.

One feature of this second preferred embodiment is as follows. A toner supplied from a toner cartridge is previously stored in a reserve tank so that the toner stored in the reserve tank is discharged when the toner in the cartridge runs short. Thus, toner cartridges for toners of colors, which run short, are simultaneously exchanged to decrease the number of exchanging operations.

That is, the toner specific concentration gradually falls from a level higher than a level L1 by continuing to carry out a copying operation. Referring to FIG. 12, in relation to this process, the definition of each level for toner supply will be described as follows. When the toner specific concentration falls to a level between levels L1 and L2 (part A), the copying operation is not discontinued, and the toner is supplied for a predetermined period of time while the copying operation is carried out. When the toner specific concentration is at a level between the levels L2 and L3 (part B), the toner is always supplied while the copying operation is carried out. When the toner specific concentration falls to a level which is slightly less than the level L3 (part C), the copying operation is discontinued, and the toner is supplied for a predetermined period of time. Thus, the toner specific concentration returns to a level which is higher than the level L3, so that a copying operation is thereafter resumed. When the toner specific concentration falls to a level which is greatly less than the level L3 (part D), the copying operation is discontinued, and the toner is supplied for a predetermined period of time. However, since the toner specific concentration does not return to the level L3 even if the toner is supplied for the predetermined period of time, the toner empty is determined while the copying operation discontinues, and a toner empty is displayed. The part E shows that the user has replaced the toner cartridge and the toner has been supplied for the predetermined period of time, so that the toner specific concentration has returned to the level L1.

Figure 10:
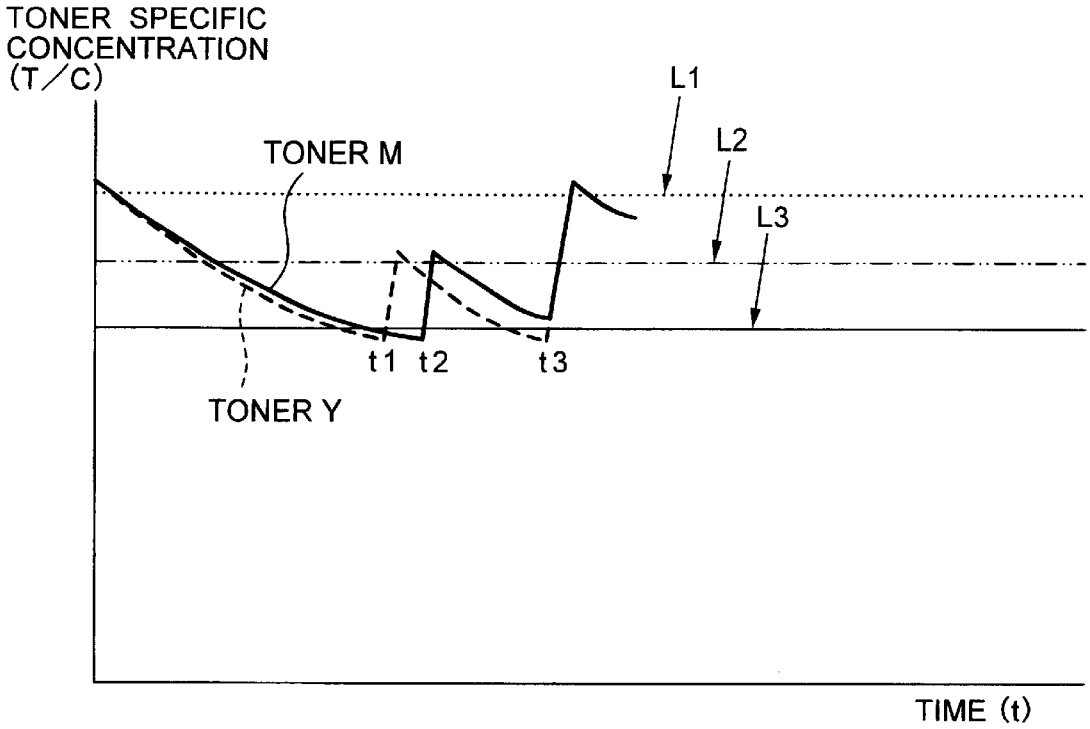
FIG. 10 is a graph showing the example of the operation in another preferred embodiment of the present invention.

An example of the operation of this preferred embodiment will be described below. FIG. 10 shows the variations in toner specific concentration. In FIG. 10, the above described three levels L1 through L3 are shown.

In FIG. 10, a dotted line shows the level of the toner Y, and a solid line shows the level of the toner M. The level of the toner Y falls below the level L3 at time t1 (a first toner empty determination(Y)). At this time, the toner is supplied from the reserve tank, and the level rises to the level L2. The concentration level of the toner M falls below the level L3 at time t2 (a first toner empty determination(M)). Similar to the toner Y, the toner M is supplied from the reserve tank, so that the level of M rises to the level L2. At time t3, the level of the toner Y falls below the level L3 again (a second toner empty determination (Y)). At this time, the level of the toner M does not yet fall below the level L3. However, since the reserve tank for the toner M has also been used, a message indicating the toner empty is displayed with respect to both of the toners Y and M to have the user replace the toner cartridges. Thus, the concentration levels of the toners Y and M rise to the level L1.

Figure 6:
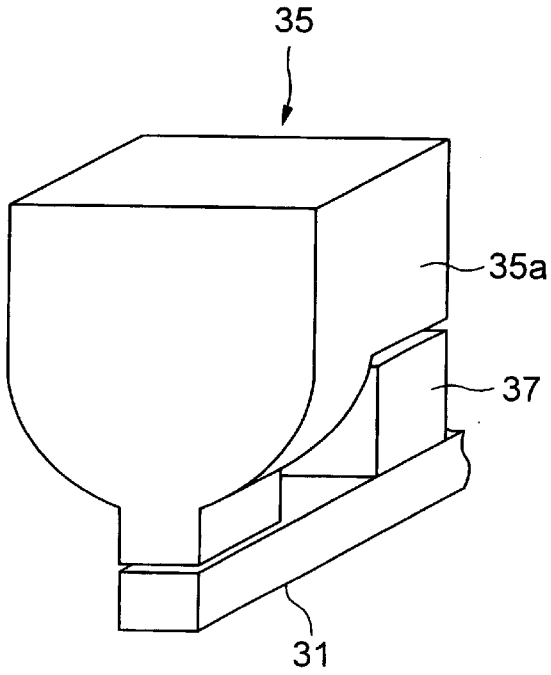
FIG. 6 is a perspective view of a principal part of another preferred embodiment of the present invention.
Figure 7:
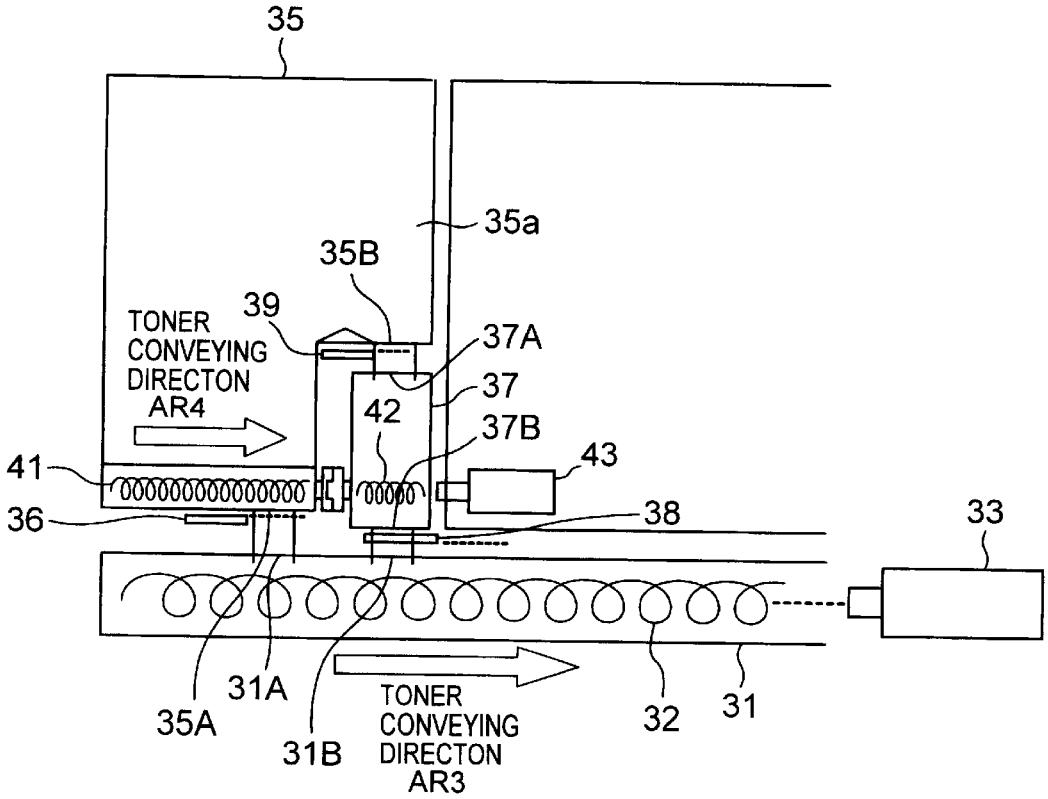
FIG. 7 is a perspective view of a principal part of another referred embodiment of the present invention.
Figure 8:
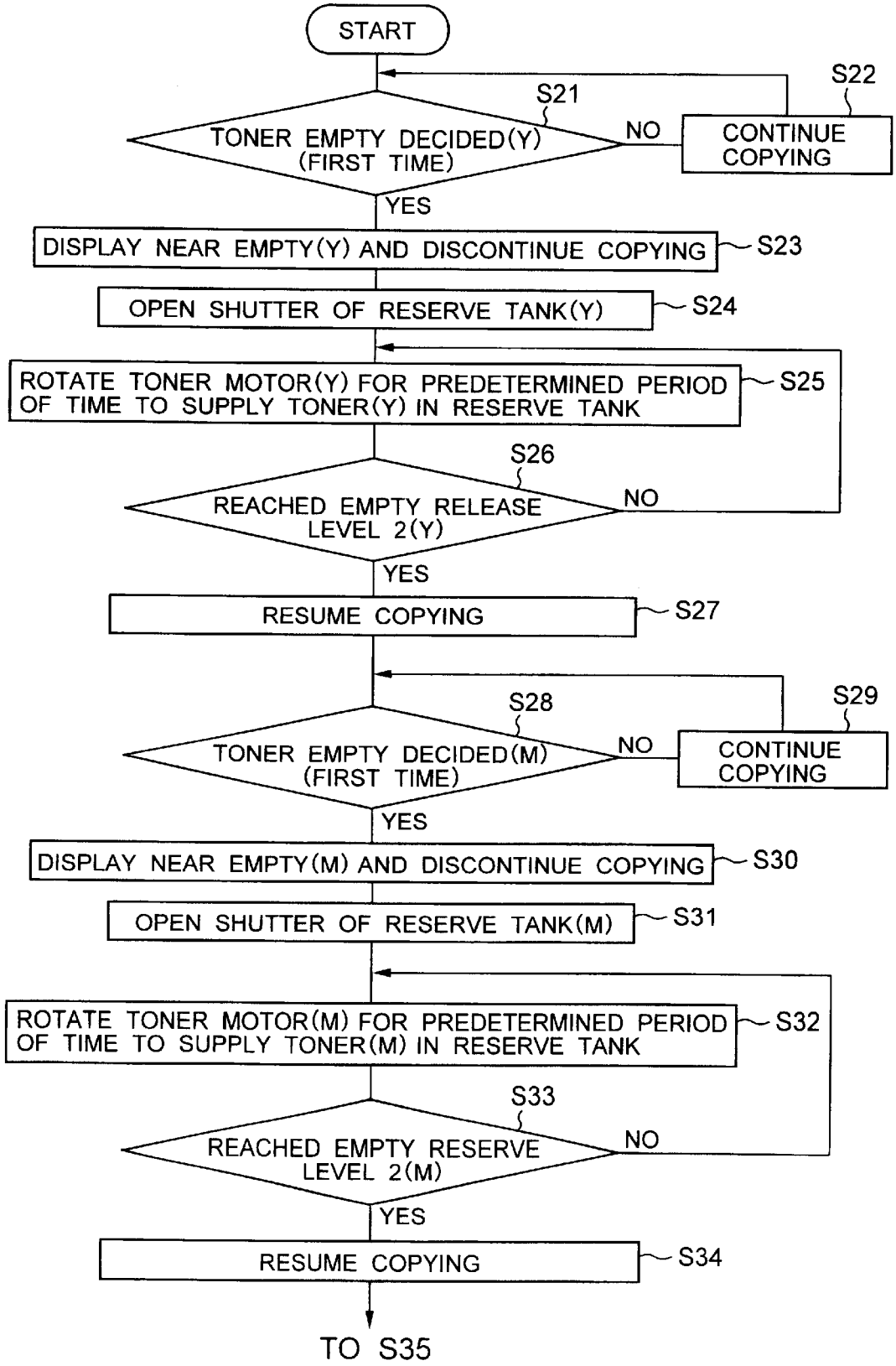
FIG. 8 is a part of a flow chart of an example of an operation in another preferred embodiment of the present invention.

A principal part of a system for realizing the above described operation according to the present invention is shown in FIGS. 6 and 7. The entire constitution of a picture image forming system is the same as that described by referring to FIG. 1, so that the description thereof is omitted. This system is similarly formed with respect to each color of the toners Y, M, C and K.

In FIGS. 6 and 7, reference number 31 denotes a toner tank which has a toner conveying auger 32 therein. This auger 32 is rotated by a developing device motor 33. By the rotation of the auger 32, a toner, together with a developer, is agitated, and the toner is conveyed in a direction of arrow AR3 to be fed to a developing part. In the toner tank 31, a sensor for detecting a toner concentration ratio is provided.

On the toner tank 31, a toner cartridge 35 is detachably mounted. In the bottom face of the toner tank 35, a first opening 35A is provided. The opening 35A has a lid 36. The lid 36 opens the opening 35A when the cartridge 35 is attached to the toner tank 31, and closes the opening 35A to prevent the leakage of the toner when the cartridge 35 is detached from the toner tank 31. A first toner inlet 31A is formed in the toner tank 31 so as to face the first opening 35A. A usual toner supply passage is formed therein.

A part of the toner cartridge 35 is an expanded portion 35*a* protruding so as to have a pent-roof shape. Between the expanded portion 35*a* and the toner tank 31, a reserve tank 37 for connecting them is provided. The top face of the reserve tank 37 is provided with a top opening 37A for receiving a toner, and the bottom face of the reserve tank 37 is provided with a bottom opening 37B for releasing the toner. The bottom opening 37B has a shutter 38. The shutter 38 is usually closed, and is opened when discharging the toner to the toner tank 31. Such a reserve tank 37 is attached between the expanded portion 35*a* of the toner cartridge 35 and the toner tank 31. In this state, a second opening 35B is provided on the bottom face of the expanded portion so as to face the top opening 37A of the reserve tank 37. The opening 35B has a lid 39 which closes the opening 35B when the cartridge 35 is detached. The toner tank 31 is formed with a second toner inlet 31B which faces the bottom opening 37B of the reserve tank 37. A reserving supply passage is formed therein.

In the toner cartridge 35 and the reserve tank 37, augers 41 and 42 are provided on the bottom portions thereof, respectively. The augers 41 and 42 are integral with each other so as to rotate simultaneously. The augers 41 and 42 are connected to a toner motor 43 to be rotated by the motor 43. A general purpose display device (not shown) is provided for displaying messages indicating a near empty and a toner empty.

In the above described system, when the toner cartridge 35 is attached to the toner tank 31, the two lids 36 and 39 are open, so that the first opening 35A and the second opening 35B are communicated with the first inlet 31A and the top opening 37A, respectively. However, the bottom opening 37B and the second inlet 31B are in a non-communication state by the shutter 38. Then, if the toner runs short in the toner cartridge 35, the shutter 38 is opened to supply the toner from the reserve tank 37 to the toner tank 31.

Figure 9:
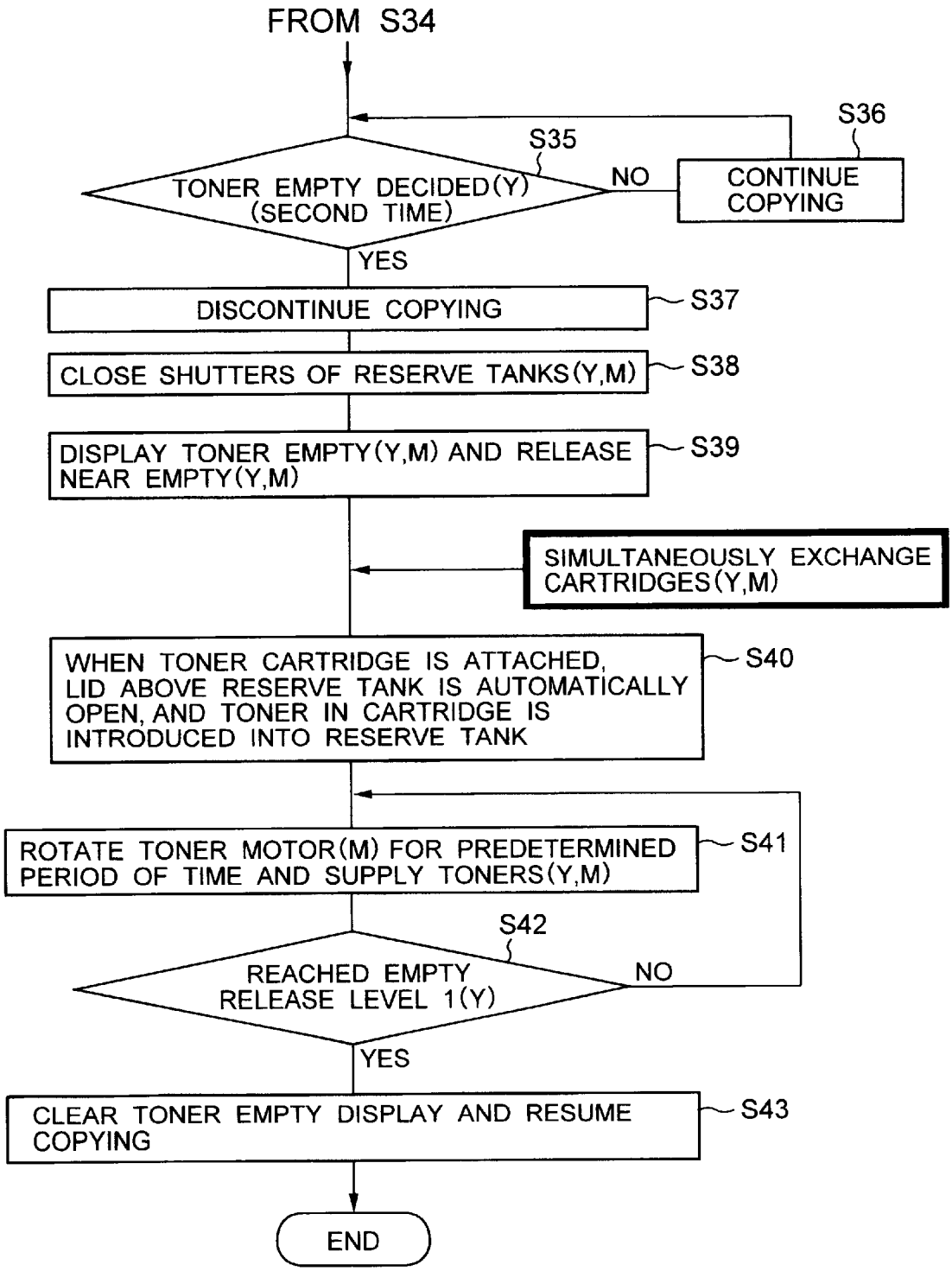
FIG. 9 is a part of the flow chart of the example of the operation in another preferred embodiment of the present invention.

Referring to the flow charts of FIGS. 9 and 10, an example of an operation shown in FIG. 11 will be described below.

Figure 11:
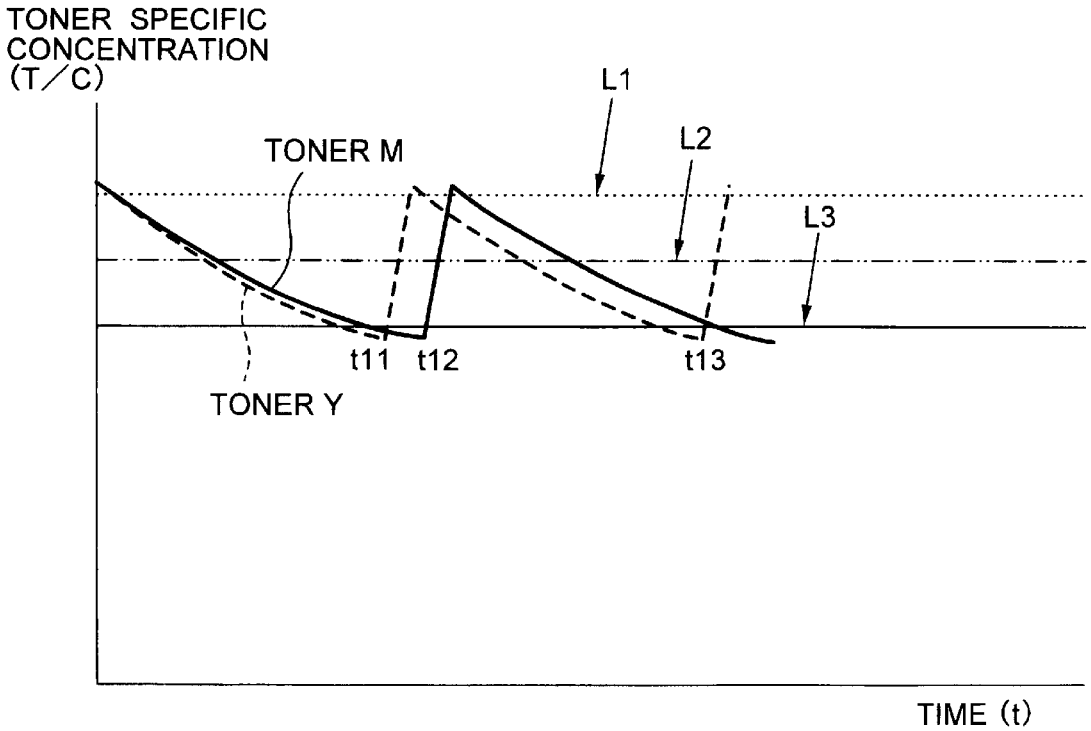
FIG. 11 is a graph showing an example of an operation in a conventional picture image forming system.

As shown in FIG. 11, an example of a state that the toner Y first runs out and then the toner M decreases will be described herein.

When the toners Y, M, C and K sufficiently remain (when toner specific concentrations are sufficiently high), a copying operation continues as shown at steps S21 and S22.

When the toner specific concentration of the toner Y decreases to reach the toner empty state, i.e., to reach the toner supply level L3 (YES of step S21), a near empty message is displayed with respect to the toner Y to discontinue the copying operation (step S23). At this time, the shutter 38 of the reserve tank 38 for the toner Y is open (step S24). Thereafter, the toner motor 43 for the toner Y is rotated for a predetermined period of time to rotate the auger 42 in the reserve tank 37 to supply the toner Y from the reserve tank 37 to the toner tank 31 via the second inlet 31B (step S25). The developing device motor 33 is also rotated to convey the toner from the toner tank 31 to the developing device. This operation is repeated until the toner specific concentration of the toner Y reaches the toner supply level (the empty release level 2) L2. Thus, the toner specific concentration of the toner Y is increasing (see t1 of FIG. 10).

When the toner specific concentration of the toner Y reaches the empty release level L2 (YES of step S26), the near empty message continues to be displayed, and a copying operation is resumed (step S27).

The copying operation continues until, e.g., the level of the toner M gets becomes lower due to the subsequent continuous copying operation (NO of step S28, step S29).

For example, when the copying operation continues and the toner empty is determined (YES of step S28), i.e., when the toner specific concentration of the toner M reaches the toner supply level L3 (see t2 of FIG. 11), an near empty message is displayed with respect to the toner M to discontinue the copying operation (step S30). Simultaneously, the shutter 38 of the reserve tank 38 for the toner M is opened (step S31). At this time, the toner motor 43 is rotated to rotate the auger 42 in the reserve tank 37 to supply the toner M from the reserve tank 37 to the toner tank 31 via the second inlet 31B (step S32). This operation continues with respect to the toner M until the toner specific concentration of the toner M reaches the empty removed level 2 (step S32, NO of step S33). When the concentration of the toner M reaches the empty removed level L2 (YES of step S33), a copying operation is resumed while the toner empty message is displayed (step S34).

This copying operation continues until a specific state occurs in which any one of the toners Y, M, C and K decreases (step S35, NO of step S36).

When the toner empty for the toner Y is determined (second time) by the continuous copying operation (YES of step S35), the copying operation discontinues (step S37). At this time, the shutters 38 of the reserve tanks for the toners Y and M are closed (step S38). The near empty message for each of the toners Y and M, which has been displayed, is cleared, and a toner empty message for each of the toners Y and M is newly displayed (step S39).

Thereafter, the user can simultaneously replace the toner cartridges 35 for the toners Y and M.

When the toner cartridges for the toners Y and M are attached, the lids 39 of the toner cartridges 35 are automatically opened to open the second opening 35B. Thus, the toners Y and M in the toner cartridges 35 are introduced into the reserve tanks 37 via the top openings 37A (step S40). At this time, as described above, the lids 36 are open to introduce the toners from the toner cartridges 35 to the toner tanks 31.

Thereafter, the toner motors 43 for the toners Y and M are rotated for a predetermined period of time to supply the toners (step S41). This operation continues until the toner level of the toner Y reaches the empty release level L1 (NO of step S42, step S41).

When the toner level of each of the toners Y and M reaches the empty release level L1 (YES of step S42), the toner empty display for each of the toners Y and M is cleared, and a copying operation is resumed (step S43).

In the above described second preferred embodiment, the relationship between the toner specific concentration and the replacement of the cartridge has been described by referring to FIG. 10. Referring to FIG. 11, in response to this, an example of a conventional case will be described below. That is, in FIG. 11, toner supply levels L1 through L3 are the same as those in FIG. 10. In FIG. 11, the toner specific concentration of the toner Y is the toner supply level L3 at time t11. That is, the toner empty for the toner Y is determined (first time) at time t11, so that the toner cartridge is replaced. At time t12, the toner specific concentration of the toner M is below the level L3. Therefore, the toner empty for the toner M is determined (first time), so that the toner cartridge is replaced. That is, it is necessary to perform two separate toner cartridge replacement operations in a short time. The toner specific concentration for the toner Y is below at time t13 again. At this time, the toner cartridge for the toner Y is replaced.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A toner supply method in a picture image forming system having a plurality of picture image forming parts, each of which is designed to supply a toner from a toner cartridge to a developing part, said toner supply method comprising the steps of:

detecting a cartridge empty when the level of said toner in said toner cartridge of any one of said picture image forming parts reaches an empty level;

introducing a toner, which remains in said toner cartridge of each of said plurality of picture image forming parts, from said toner cartridge of a corresponding one of said plurality of picture image forming parts into a reserve tank portion, which is provided so as to correspond to each of said toner cartridges for housing therein a predetermined quantity of toner, when said cartridge empty is detected in any one of said picture image forming parts;

detecting a toner empty when the level of said toner in said developing part reaches an empty level in any one of said picture image forming parts; and inspiring to replace all of said toner cartridges, for which a cartridge empty has been detected, with new cartridges when said toner empty is detected in any one of said picture image forming parts.

2. A toner supply method as set forth in claim 1, wherein during a usual picture image formation, said toner is supplied from said toner cartridge to said reserve tank portion via a reserving supply passage which is different from a supply passage provided for supplying said toner from said toner cartridge to said developing part.

3. A toner supply method as set forth in claim 2, wherein said reserving supply passage is provided with a shutter which is open when said toner is supplied.

4. A toner supply method as set forth in claim 1, which further comprises a step of displaying a message indicating that, the level of said toner in a corresponding one of said developing parts reaches a near empty level when said cartridge empty is detected in any one of said picture image forming parts.

5. A toner supply method as set forth in claim 1, wherein said cartridge empty is detected by a sensor which is provided in each of said toner cartridges.

6. A toner supply method in a picture image forming system including first and second picture image forming parts, each of which is designed to supply a toner from a toner cartridge to a developing part, said toner supply method comprising the steps of:

detecting a cartridge empty of said first picture image forming part when the level of a toner in said toner cartridge of said first picture image forming part reaches an empty level;

introducing a toner, which remains in each of said toner cartridges of said first and second picture image forming parts, from each of said toner cartridges of said first and second picture image forming parts into a reserve tank, which is provided so as to correspond to each of said toner cartridges for housing therein a predetermined quantity of toner, when said cartridge empty is detected in said first picture image forming part;

detecting a cartridge empty of said second picture image forming part when the level of a toner in said toner cartridge of said second picture image forming part reaches an empty level;

introducing a toner, which remains in each of said toner cartridges of said first and second picture image forming parts, from each of said toner cartridges of said first and second picture image forming parts into the reserve tank, which is provided so as to correspond to each of said toner cartridges for housing therein a predetermined quantity of toner, when said cartridge empty is detected in said second picture image forming part;

detecting a toner empty of a corresponding one of said first and second image forming parts when the level of said toner in said developing part of any one of said first and second picture image forming parts reaches said empty level; and inspiring to replace said toner cartridges of said first and second picture image forming parts with new cartridges when said toner empty is detected in any one of said first and second picture image forming parts.

7. A picture image forming system comprising:

a plurality of developing means, each of which houses a toner, therein for forming a developer image with said toner;

a plurality of toner cartridges, each of which is provided so as to correspond to a corresponding one of said plurality of developing means for supplying said toner to said corresponding one of said plurality of developing means;

a plurality of reserve tank portions, each of which is provided between said corresponding one of said plurality of developing means and a corresponding one of said plurality of toner cartridges, for housing therein a predetermined quantity of toner to supply said toner to said corresponding one of said plurality of developing means;

a plurality of cartridge empty detecting means, each of which is provided in said corresponding one of said plurality of toner cartridges, for detecting that the level of said toner in said corresponding one of said plurality of toner cartridges reaches an empty level;

a plurality of toner empty detecting means, each of which is provided in said corresponding one of said plurality of developing means, for detecting that the level of said toner in said corresponding one of said plurality of developing means reaches an empty level;

introducing means for introducing a toner, which remains in a corresponding one of said plurality of toner cartridges, from said corresponding one of said plurality of toner cartridges to a corresponding one of said reserve tank portions when a cartridge empty of any one of said plurality of toner cartridges is detected by a corresponding one of said plurality of cartridge empty detecting means; and display means for displaying to inspire to replace with new ones one or more toner cartridges of said plurality of toner cartridges, the level of which has reached said cartridge empty, when a toner empty of any one of said plurality of developing means is detected by a corresponding one of said plurality of toner empty detecting means after said toner is introduced by said introducing means.

8. A picture image forming system as set forth in claim 7, wherein said introducing means is provided with a shutter for establishing or blocking a toner supply passage which is provided between a corresponding one of said reserve tank portions and a corresponding one of said toner cartridges.

9. A picture image forming system as set forth in claim 7, which further comprises means for displaying a message indicating that the level of a toner in a corresponding one of said plurality of developing means reaches a near empty level when said cartridge empty is detected in any one of said plurality of toner cartridges.

10. A picture image forming system as set forth in claim 7, wherein said plurality of toner cartridges include first and second toner cartridges, and said display means displays a message to inspire to replace both of said first and second toner cartridges with new ones when said toner empty is detected in a corresponding one of said plurality of developing means, which corresponds to any one of said first and second toner cartridges after said cartridge empty is detected in said first and second toner cartridges.

11. A toner supply method in a picture image forming system having a plurality of picture image forming parts, each of which is designed to supply a toner from a toner cartridge to a developing part, said toner supply method comprising the steps of:

detecting a toner empty when the level of said toner in said developing part in any one of said picture image forming parts reaches an empty level;

supplying a toner to a developing part from a reserve tank portion, which is provided in each of said picture image forming parts and which stores therein a predetermined quantity of toner, via a reserving supply passage in a corresponding one of said picture image forming parts, when said toner empty is detected in said corresponding one of said picture image forming parts; and inspiring to replace with new ones toner cartridges of all of picture image forming parts, in which said toner empty has been detected, when a toner empty is detected again in any one of said picture image forming parts after said toner is supplied from said reserve tank to said developing part.

12. A toner supply method as set forth in claim 11, wherein said toner empty is detected when the level of said toner in said developing part does not reach a predetermined level even if said toner is supplied from said toner cartridge to said developing part.

13. A toner supply method as set forth in claim 11, which further comprises a step of displaying a message indicating that the level of a toner in a corresponding one of said developing parts reaches a near empty level, when said toner empty is detected in any one of said picture image forming parts.

14. A toner supply method as set forth in claim 11, wherein said reserving supply passage is provided with a shutter for establishing or blocking said reserving supply passage by opening or closing said shutter.

15. A toner supply method as set forth in claim 11, wherein when a toner empty is detected in any one of said picture image forming parts, a picture image formation is discontinued, and after said toner is supplied from said reserve tank portion, the picture image formation is resumed.

16. A toner supply method in a picture image forming system having first and second picture image forming parts, said toner supply method comprising the steps of:

detecting a toner empty in said first picture image forming part;

discontinuing forming a picture image when said toner empty is detected in said first picture image forming part, and resuming forming a picture image after a toner is supplied to a corresponding developing part from a reserve tank portion which is provided in said first picture image forming part;

detecting a toner empty in said second picture image forming part;

discontinuing forming a picture image when said toner empty is detected in said second picture image forming part, and resuming forming a picture image after a toner is supplied to a corresponding developing part from a reserve tank portion which is provided with said second picture image forming part; and inspiring to replace toner cartridges of said first and second picture image forming parts with new ones when a toner empty is detected again in said first or second picture image forming part.

17. A picture image forming system comprising:

a plurality of developing means, each of which houses therein a toner, for forming a developer image with said toner;

a plurality of toner cartridges, each of which is provided so as to correspond to a corresponding one of said plurality of developing means, for supplying said toner to said corresponding one of said plurality of developing means;

a plurality of reserve tank portions, each of which is provided so as to correspond to said corresponding one of said plurality of developing means, for housing therein a predetermined quantity of toner to supply said toner to said corresponding one of said plurality of developing means;

a plurality of toner empty detecting means, each of which is provided in said corresponding one of said plurality of developing means, for detecting that the level of said toner in said corresponding one of said plurality of developing means reaches an empty level;

supply means for supplying a toner from a corresponding one of said reserve tank portions to said corresponding one of said plurality of developing means when a toner empty of any one of said plurality of developing means is detected by a corresponding one of said plurality of toner empty detecting means; and display means for displaying a message to inspire to replace with new ones all of corresponding cartridges of said plurality of toner cartridges, which correspond to one or more of said plurality of developing means, in which a toner empty has been detected, when a toner empty of any one of said plurality of developing means is detected by a corresponding one of said plurality of toner empty detecting means after said toner is supplied by said supply means.

18. A picture image forming system as set forth in claim 17, wherein said supply means is provided with a shutter for establishing or blocking a toner supply passage between said reserve tank portions and said developing means.

19. A picture image forming system as set forth in claim 17, wherein said toner empty is detected when the level of the toner in said developing means does not reach a predetermined level even if the toner is supplied from a corresponding one of said plurality of toner cartridges to a corresponding one of said plurality of developing means.

20. A picture image forming system as set forth in claim 17, which further comprises display means for displaying a message indicating that the level of a toner in a corresponding one of said developing means reaches a near empty level, when said toner empty reaches detected in any one of said plurality of developing means.

21. A picture image forming system as set forth in claim 17, wherein when said toner empty is detected in any one of said plurality of developing means, a picture image formation is discontinued, and after a toner is supplied from a corresponding one of said reserve tank portions to a corresponding one of said plurality of developing means, the picture image formation is resumed.

22. A picture image forming system as set forth in claim 17, wherein said plurality of developing means include first and second developing means, and wherein after a toner empty in each of said first and second developing means is detected to supply a toner from a corresponding one of said reserve tank portions, a toner empty is detected again in any one of said first and second developing means, said display means inspires to replace toner cartridges corresponding to said first and second developing means with new ones.

* * * * *